United States Patent [19]

Hugot

[11] 3,935,491

[45] Jan. 27, 1976

[54] DISCHARGE LAMP

[75] Inventor: André Albert Hugot, Hauts-de-Seine, France

[73] Assignee: Compagnie Electro Mecanique, Paris, France

[22] Filed: Mar. 3, 1975

[21] Appl. No.: 554,527

Related U.S. Application Data

[63] Continuation-in-part of Ser. No. 400,149, Sept. 24, 1973, abandoned.

[52] U.S. Cl. ..... 313/25; 313/182; 313/312

[51] Int. Cl.[2] ..... H01J 61/52

[58] Field of Search ..... 313/17, 25, 26, 182, 312

[56] References Cited

UNITED STATES PATENTS 3,665,235 5/1972 Hugot ..... 313/26 X

*Primary Examiner*—R. V. Rolinec
*Assistant Examiner*—Darwin R. Hostetter
*Attorney, Agent, or Firm*—Stevens, Davis, Miller & Mosher

[57] ABSTRACT

An elongated discharge lamp which is particularly intended for use in photo-chemical reaction processes. The discharge tube of the lamp is supported at its ends by two end mountings, one of which carries the input terminals for the lamp. A conductor extending along the length of the discharge tube joins one of the terminals to the electrode at the remote end of the tube, and the tube and conductor are separately enclosed in respective transparent tubular envelopes sealed to the end mountings at their ends.

A liquid-cooling jacket is provided, cooling liquid being circulated therethrough by means of a tube of transparent material supported in the end mountings.

5 Claims, 7 Drawing Figures

DISCHARGE LAMP

BACKGROUND OF THE INVENTION

This is a continuation in part of application Ser. No. 400,149, filed on Sept. 24, 1973, now abandoned.

The present invention relates to elongated discharge lamps having electrical supply terminals at one end, and particularly, but not exclusively, to such lamps intended for use in photo-chemical processes.

In a known form of elongated discharge lamp, as illustrated in FIG. 1, a discharge tube 1 is formed by an elongated ampoule of transparent material, generally of quartz, through the ends of which electrodes pass, usually of tungsten or molybdenum. The ampoule contains one or more substances such as mercury vapour, or other gases according to the type of discharge required.

The discharge tube 1 is enclosed within an envelope 2 of transparent material, such as glass or quartz, supported by supports 3 and 4, the envelope 2 being filled with an inert gas such as nitrogen. For the more powerful lamps, the envelope is surrounded by a transparent jacket 5 within which cooling fluid is circulated by means of an inlet tube 6 and an outlet tube 7.

In use, the lamp is immersed in a chemical reaction chamber to induce the desired photo-chemical reaction. Its supply of electricity and of water, is effected at one end only. Thus an electrical conductor 8 has to be provided for supplying the electrode at the opposite end. This conductor traverses the length of the discharge tube 1 on inside of the envelope 2.

In another known form of lamp, the discharge tube is supported in a metal support structure comprising two members at the ends of the discharge tube, said members being connected by at least two metal rods which extend along the length of the discharge tube. This support is used for conducting current to the electrode which is furthest away from the supply end.

A difficulty with the prior art devices is that the diameter of the envelope is large with respect to that of the discharge tube. For example, in the case of a construction with a single return conductor, a discharge tube of 55mm in diameter will require an envelope having a diameter of 90mm; in the case of a discharge tube retained in a metallic support, a discharge tube of 55mm will require a diameter of 150mm for the envelope.

Thus, these prior art devices require an envelope of large diameter which is a disadvantage for the following reasons:

they are cumbersome the cooling of the discharge tube is poor because of the large size of the space between the tube and the envelope;

the high cost of the envelope, which — all other things being equal — is a function of its diameter. In addition, in the case of very high power lamps (of power greater for example than 20kw), or for reasons concerning the coefficient of radiation transmission, it is necessary to replace the lamp envelope of borosilicate glass (which is insufficient to resist temperature gradients to which it is subjected and has a low coefficient of transmission at certain wavelengths) by a material which is more resistant to the high temperature gradients and more transparent to the desired radiation (for example by quartz). As the cost of quartz is ten times higher than borosilicate glass, quartz envelopes of large diameter are very expensive.

SUMMARY OF THE INVENTION

The primary object of the present invention is to provide a lamp which does not suffer from the above described disadvantages.

A second object of the present invention is to provide a lamp comprising a discharge tube which is supported at its ends by respective mountings of which one, the head mounting, comprises current supply terminals, and an elongated conductor connecting one of said current supply terminals to the remote electrode of the tube. The discharge tube and preferably this elongated conductor are each enclosed in a respective tubular envelope which may have reduced dimensions and which is joined to the mountings in a sealing tight manner.

Advantageously, the tubular envelope of the conductor is transparent.

The lamp may be equipped with an outer jacket for cooling by the circulation of fluid, this jacket being joined in a sealing tight manner to the head mounting and the cooling device comprising an inlet tube which passes through both mountings and an outlet tube passing through the head mounting.

This inlet tube is advantageously transparent, at least in its portion situated between the two mountings, which permits the shadow angle of the lamp to be reduced to the minimum.

The description which follows with reference to the attached drawings, given by way of non-limiting example, will enable the manner in which the invention can be carried into effect to be better understood.

DESCRIPTION OF THE PREFERRED EMBODIMENT

Figure 1:
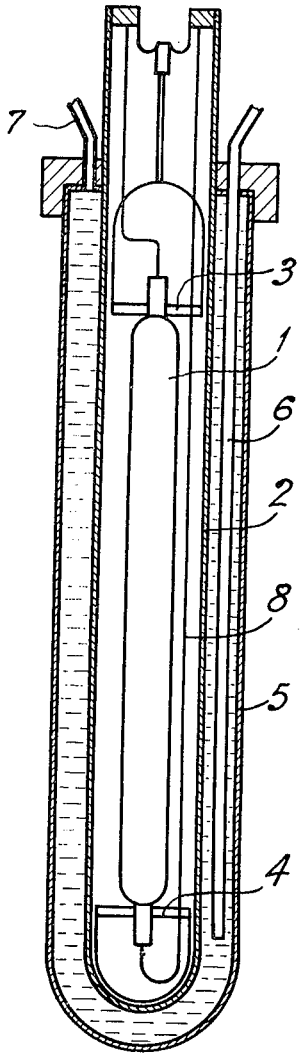
FIG. 1 is a diagrammatic view in longitudinal section of a known lamp the description of which has been given in the introduction to the present specification.

Referring to FIGS. 2–5, a discharge tube 10 of a known type, comprising two electrodes **10*a* and 10*b* and two end fittings 10*c* and 10*d*, is supported by an upper end mounting 11 and a lower end mounting 12**.

The upper end mounting 11 consists essentially of a tubular metal member 13, which is fastened by screws on a annular metal base plate 14, having a larger outer diameter.

A cylindrical fluid-cooling jacket 15, having an open upper end and a closed lower end, and consisting of a transparent material, is disposed around the discharge tube 10 and the lower end mounting 12, just under the upper end mounting 11. A tapered outer rim **15*a* is formed around the open upper end of the fluid-cooling jacket 15, and this outer rim 15*a* is engaged into a substantially circular opening of a support plate 16, a sealing ring 17 being preferably interposed between elements 15*a* and 16. This support plate 16 is for instance the cover plate of a tank in which a photochemical process is to be effected. The base plate 14 lies on the open upper end of the fluid-cooling jacket 15, a sealing ring 18 being interposed therebetween. As the outer diameter of the annular base plate 14 is superior to the outer diameter of the upper end of the fluid-cooling jacket 15, the rim of the said base plate 14 can be fastenend by screws 19 (FIGS. 2 and 4) to the upper face of the support plate 16**.

The lower end mounting 12 also consists essentially of a tubular metal member, which is supported, in the lower inside part of the fluid-cooling jacket 15, by a ring-shaped member 20, preferably consisting of an insulating material.

Both upper and lower end mountings, 11 and 12, are formed with first coaxial bores 11*a* and 12*a*, having a same predetermined diameter, substantially superior to the outer diameter of the discharge tube 10, and with second coaxial bores 11*b* and 12*b*, having a same diameter, much inferior to said predetermined diameter. A first and a second tubular envelopes, 21*a* and 21*b*, consisting of a transparent material, have their respective upper and lower ends engaged in the coaxial first and second bores of the upper and lower end mountings, 11 and 12 respectively, so that the said first envelope 21*a* surrounds the discharge tube 10.

In the embodiment illustrated in FIGS. 2–5, the first and second tubular envelopes 21*a* and 21*b* have respective outer diameters slightly inferior to the respective inner diameters of first and second coaxial bores 11*a*–12*a* and 11*b*–12*b*, so that there are annular gaps between the ends of the said envelopes 21*a* and 21*b* and the inner walls of the said coaxial bores, a pair of sealing rings 22*a* or 22*b* being inserted in each of the said gaps.

The inner diameter of the first envelope 21*a* is chosen to be slightly superior to the outer diameter of the discharge tube 10, so that the gap 23 therebetween is very much inferior to the outer diameter of the second envelope 21*b*. For instance, the discharge tube 10 has an outer diameter of 55 mm and the first envelope 21*a* has an outer diameter of 65 mm and a thickness of 3 mm, so that the gap 23 is about 2 mm. wide.

The wall thickness of the second envelope 21*b* may be inferior to the wall thickness of the first envelope 21*a*.

The first coaxial bores of the upper and lower end mountings, 11 and 12, are tightly closed by upper and lower closing plates of an insulating material, 24 and 25, which may be glued thereto, so as to form, inside of the first envelope 21*a*, a tight closed room, in which the discharge tube 10 is placed lying on the said lower closing plate 25, and which may be filled with an inert gas.

A first and a second insulated electric current supply terminals, 26*a* and 26*b*, are mounted in the upper end mounting 11, respectively in the upper closing plate 24 and in the upper end of an enlarged upper portion of the second bore 11*b*. The terminals 26*a*, 26*b* are preferably covered by a cap 13*a*. The first terminal 26*a* is electrically connected to the first electrode 10*a* of the discharge tube 10, through a conductive rod 27, placed along the vertical axis of the first tubular envelope 21*a* and the upper end fitting 10*c* of the said discharge tube 10. The second terminal 26*b* is electrically connected to an elongated conductor 28, extending along the vertical axis of the second tubular envelope 21*b*; the lower end 28*a* of the said elongated conductor 28 extends outside of the lower end of the second envelope 21*b*, through a passage arranged in the lower end mounting 12 between its second and first bores 12*b* and 12*a*, and the said lower end 28*a* of the elongated conductor 28 is electrically connected to the second electrode 10*b* of the discharge tube 10, through an electric terminal 29, mounted in the lower closing plate 25, and lower end fitting 10*d* of the said discharge tube 10.

Figure 5:
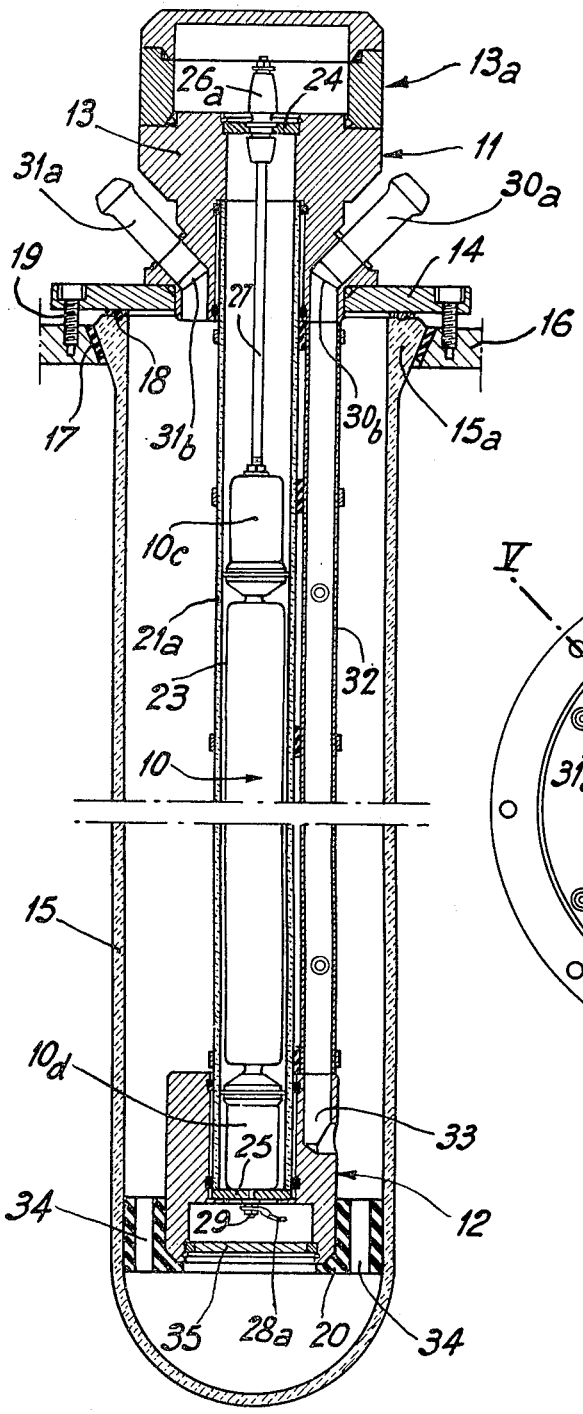
FIG. 5 is a view in section on V—V of FIG. 4.
Figure 4:
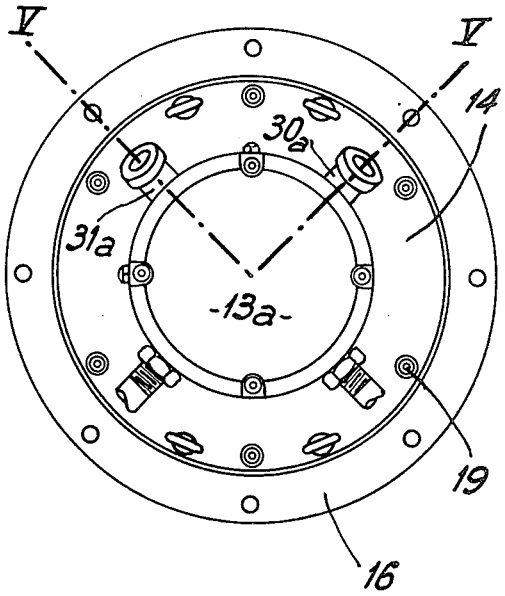
FIG. 4 is a top view of the lamp shown in FIG. 2.

A cooling fluid is circulated in the jacket 15, outside of the first and second envelopes, 21*a* and 21*b*, by means of inlet and outlet tubes, 30*a* and 31*a* respectively (FIGS. 4 and 5), which are tightly engaged in elbow-shaped bores 30*b* and 31*b* of the upper end mounting 11. Whereas the said bore 31*b* opens in the upper part of the fluid-cooling jacket 15, outside of the first envelope 21*a*, as shown in FIG. 5 the bore 30*b* opens in the upper end of a tube 32, which is disposed vertically inside of the said jacket 15, outside of and along the said first envelope 21*a*; this tube 32 consists preferably of a transparent material, and its lower end opens in an elbow-shaped bore 33, arranged in the lower end mounting 12 so as to discharge the cooling fluid in the annular space comprised between the jacket 15 and the first envelope 21*a*. Passages 34 are provided in the support ring 20 for permitting the discharged cooling fluid to sweep the closed lower end of the jacket 15. A further closing plate 35 is tightly fastened in an enlarged lower portion of the first bore 12*a* in the lower end mounting 12 for preventing the cooling fluid from sweeping the lower end 28*a* of the elongated conductor 28 and the electric terminal 29.

Figure 6:
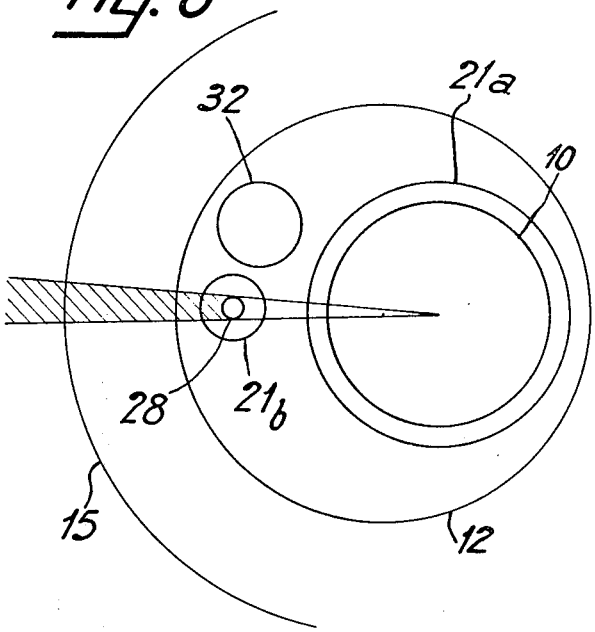
FIGS. 6 and 7 are diagrammatic sections illustrating comparatively an additional advantage of the embodiment of FIGS. 2 to 5.
Figure 7:
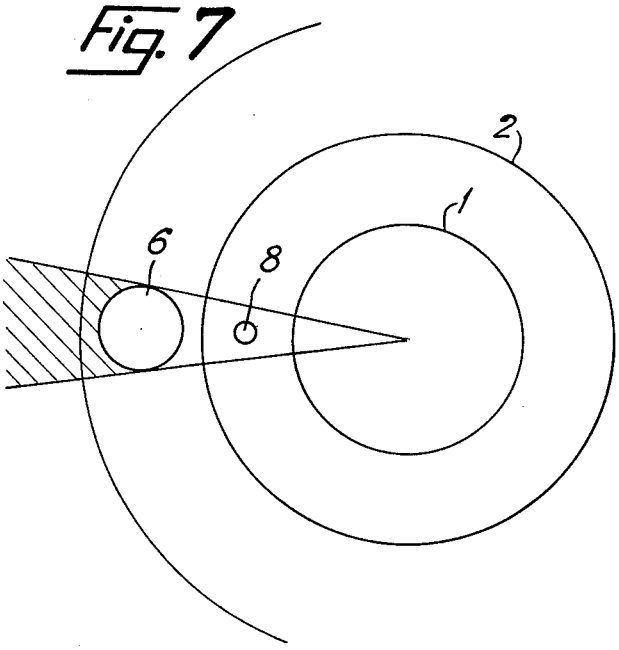
Figure 2:
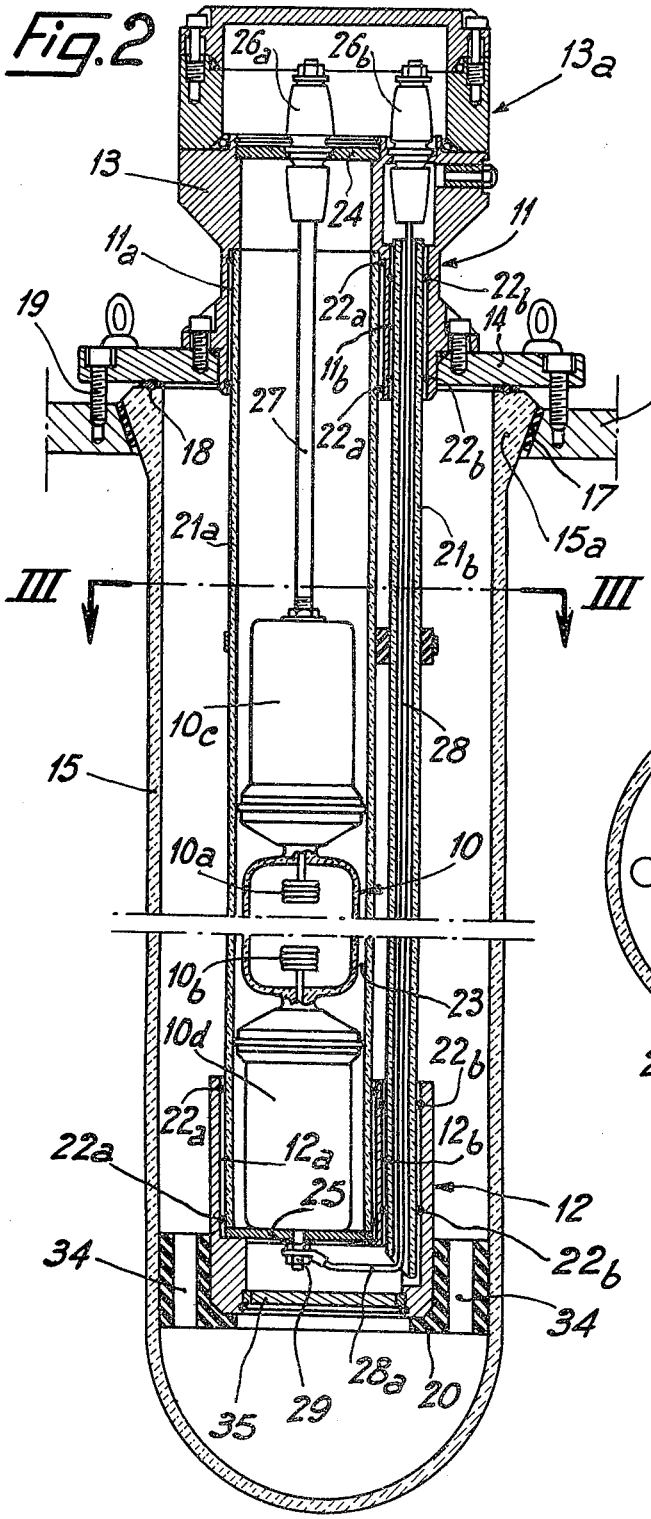
FIG. 2 is a similar view of a lamp in accordance with the present invention.
Figure 3:
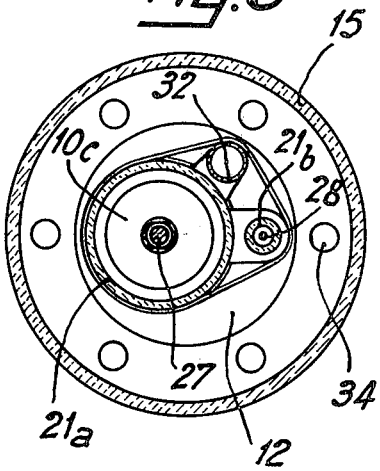
FIG. 3 is a section according to III—III in FIG. 2.

With the arrangement which has just been described, cooling of the discharge tube 10 is excellent and the specific power of the lamp can be maximized. The cost of the first envelope 21*a* is reduced to the minimum since the diameter of the said envelope is itself reduced to the minimum. This arrangement also confers an additional advantage from the point of view of the emission of radiation since the shadow angle of the lamp is produced by the elongated conductor 28 alone, as shown in FIG. 6, and this angle is about 5°. With the known lamp shown in FIG. 7, it is the metallic water inlet tube 6 which creates the shadow angle, and the latter is about 16°. Thus 11°, or 3% of the total radiation is gained. This gain, which appears a priori low, is very important from the economic point of view. In absolute value it may represent many hundreds of tons of additional product obtained annually from an industrial photo-chemical process.

What is claimed is:

1. An elongated discharge lamp comprising:

a. an elongated discharge tube including first and second electrodes at its respective first and second ends;

b. first and second end mountings supporting said discharge tube at said first and second ends thereof respectively;

c. an elongated conductor extending between said first and second end mountings;

d. first and second current supply terminals disposed at said first end mounting, said first current supply terminal being electrically connected with said first electrode and said second current supply terminal being electrically connected with said second electrode via said elongated conductor;

e. first and second tubular envelopes extending between and sealed at their ends to said first and second end mountings and surrounding said discharge tube and said elongated conductor respectively, at least said first envelope being of transparent material; and f. a fluid-cooling jacket surrounding said first and second tubular envelopes.

2. A discharge lamp in accordance with claim 1, wherein said second tubular envelope is of transparent material.

3. A discharge lamp in accordance with claim 1, in which said first tubular envelope is coaxial with said discharge tube, the wall thereof being spaced from that of the discharge tube by a distance substantially inferior to the outer diameter of said second tubular envelope.

4. Discharge lamp in accordance with claim 1, wherein said fluid-cooling jacket surrounding said tubular envelopes, is provided with a an inlet tube passing through said first and second end mountings and extending between said mountings outside of said first tubular envelope, and an outlet tube passing through said first end mounting.

5. A discharge lamp in accordance with claim 4, in which said inlet tube is transparent at least in its portion between said first and second end mountings.

* * * * *